US010945474B2

(12) United States Patent
Atkinson-Skinner

(10) Patent No.: US 10,945,474 B2
(45) Date of Patent: Mar. 16, 2021

(54) HEADBAND WITH FEATURES FOR ADDING REMOVABLE DECORATIVE ADORNMENTS

(71) Applicant: Ara Atkinson-Skinner, Bear, DE (US)

(72) Inventor: Ara Atkinson-Skinner, Bear, DE (US)

( * ) Notice: Subject to any disclaimer, the term of this patent is extended or adjusted under 35 U.S.C. 154(b) by 117 days.

(21) Appl. No.: 15/464,726

(22) Filed: Mar. 21, 2017

(65) Prior Publication Data

US 2017/0265541 A1 Sep. 21, 2017

Related U.S. Application Data

(60) Provisional application No. 62/311,041, filed on Mar. 21, 2016.

(51) Int. Cl.

| | |
|---|---|
| ***A41D 20/00*** | (2006.01) |
| ***A41D 27/08*** | (2006.01) |
| ***A45D 8/36*** | (2006.01) |
| ***A45D 8/00*** | (2006.01) |

(52) U.S. Cl.

CPC ..... *A41D 20/00* (2013.01); *A41D 27/08* (2013.01); *A45D 8/36* (2013.01); *A45D 2008/006* (2013.01)

(58) Field of Classification Search

CPC ..... A41D 20/00; A41D 27/08; A45D 8/36; A45D 2008/006

USPC ..... 2/209.3, 209.04, 209.5, 209.7, DIG. 11, 2/338; 132/275

See application file for complete search history.

(56) References Cited

U.S. PATENT DOCUMENTS

| | | | | |
|---|---|---|---|---|
| 4,795,190 | A * | 1/1989 | Weightman | B60R 22/00 280/808 |
| 6,237,611 | B1 * | 5/2001 | LeCrone | A41D 20/00 132/275 |
| 8,297,289 | B2 * | 10/2012 | Cruz | A41G 5/0093 132/275 |
| 8,646,466 | B2 * | 2/2014 | Howard | A45D 8/36 132/275 |
| 2006/0162046 | A1 * | 7/2006 | Chudzik | A45D 8/36 2/174 |
| 2007/0205235 | A1 * | 9/2007 | Knight | A45F 5/00 224/223 |
| 2012/0060263 | A1 * | 3/2012 | Harber | A41F 9/002 2/338 |
| 2014/0083444 | A1 * | 3/2014 | Grimm | A45D 8/36 132/148 |
| 2014/0109293 | A1 * | 4/2014 | Ramadan | A41D 23/00 2/207 |

* cited by examiner

*Primary Examiner* — Khoa D Huynh
*Assistant Examiner* — Aiying Zhao
(74) *Attorney, Agent, or Firm* — RatnerPrestia

(57) ABSTRACT

A headband comprising an adornment support portion comprising a plurality of slots and at least one adornment or adornment fastener strap configured to be received in at least one of the adornment support portion slots. An elastic nape section may connect to opposite ends of the adornment support portion at connection seams to dispose the headband in a closed loop configuration. The adornment fastener strap may have fastener components disposed on opposite surfaces of opposite ends of the strap operable to secure the fastener strap in a loop configuration.

18 Claims, 4 Drawing Sheets

200
222
212
220
210

102
108
102B
106
A
B 102
104
102F
A
B 100
112
114
114
W2
W1
101
160
150
162
152
117
115
110

HEADBAND WITH FEATURES FOR ADDING REMOVABLE DECORATIVE ADORNMENTS

CROSS REFERENCE TO RELATED APPLICATIONS

This application claims priority to U.S. Provisional Application Ser. No. 62/311,041, filed Mar. 21, 2016, which is incorporated by reference in its entirety.

BACKGROUND OF THE INVENTION

Fashion accessories come in all shapes and sizes. Decorative headbands can provide additional color and design to coordinate with an outfit. In particular, for a patient undergoing chemotherapy or who may be experiencing hair loss for any reason, a headband may provide the wearer with an emotional lift that comes from being able to express their personality and project beauty with an accessory that does not require hair or wig. For wearers without hair, the design of such a headband may need functional features to improve its ability stay on the user's head. Rather than having a different headband for each fashion look, there is a need in the field for a system that permits a wearer to have a comfortable "base" headband that can be personalized with various adornments and changed or enhanced to represent the wearer's personality and design choices.

SUMMARY OF THE INVENTION

One aspect of the invention comprises a headband comprising an adornment support portion comprising a plurality of slots and at least one adornment, such as a ribbon, or adornment fastener strap configured to be received in at least one of the adornment support portion slots. The headband may further comprise an elastic nape section connected to opposite ends of the adornment support portion to dispose the headband in a closed loop configuration. The elastic nape section may comprise an elastic member sandwiched between an upper fabric layer and a bottom fabric layer. The adornment support portion may comprise an anti-slip layer disposed on a surface configured to contact a wearer's head.

In one embodiment, the adornment support portion comprises a first, relatively wider fabric base portion and a second, relatively narrower fabric top portion, wherein the base and the top are connected to one another by a plurality of spaced seams such that each of the plurality of slots is defined by the first and second fabric portions between adjacent seams. In another embodiment, the adornment support portion comprises at least a base fabric portion, with at least two rows of seamed slots that penetrate the base fabric portion.

In some embodiments, the adornment fastener strap comprises fastener components, such as microhook/microloop components, disposed on opposite surfaces of opposite ends of the strap operable to secure the fastener strap in a loop configuration. In some embodiments, the adornment support portion is wider in the center than at or near the seams where it connects to the nape elastic portion.

DETAILED DESCRIPTION OF THE INVENTION

Figures 1A, 1B, 1C, 1D:
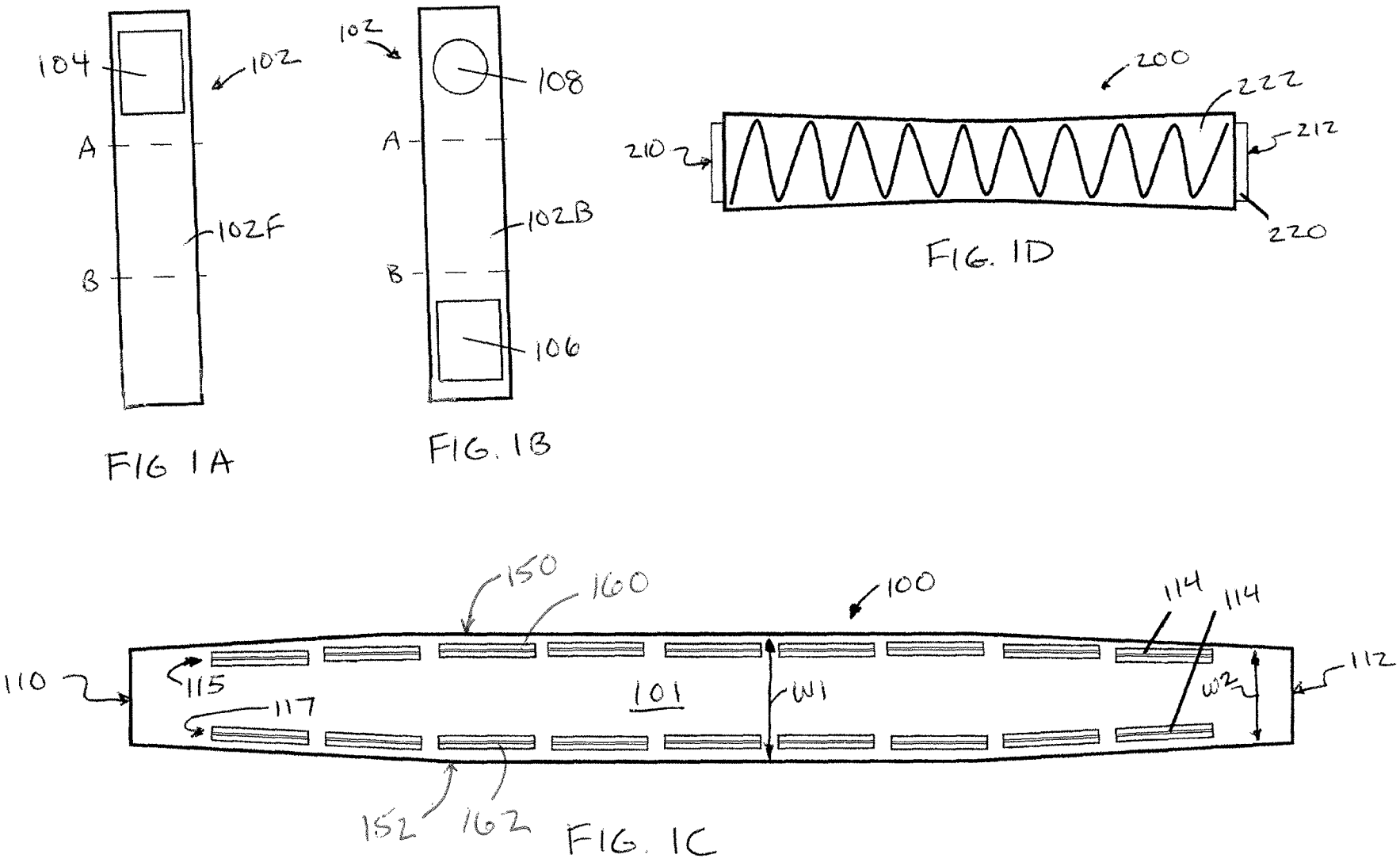
FIG. 1A depicts a plan view of a first side of an exemplary adornment fastener strap.
FIG. 1B depicts a plan view of the opposite side of the exemplary adornment fastener of FIG. 1A.
FIG. 1C depicts a plan view of one embodiment of an exemplary slotted adornment support portion.
FIG. 1D depicts a plan view of one embodiment of an exemplary headband nape elastic portion.

In various embodiments of the invention, depicted in the drawings, exemplary headbands in accordance with aspects of the invention comprise an adornment support section configured to receive adornments secured thereto and, preferably, a nape section connected to the adornment section for securing the adornment section to the wearer's head. The nape section preferably comprises an elastic member sandwiched between an upper layer and a lower layer of soft fabric, but may comprise any material or combination of materials capable of providing elastic properties. The term "elastic" is thus not limited to any particular materials of construction (e.g. it may comprise, but does not necessarily comprise, rubber or some elastomer component to impart the elastic properties). Suitable components with desirable qualities are well known in the field of clothing manufacture and design. The elastic may have sufficient stretchability to facilitate a one-size-fits-all design, or may have less stretchability to support a more tailored fit to the head size of the wearer, in which case the headbands may be made available in sizes such as small, medium, large, etc., or to meet standard head sizes akin to hat sizings (7, 7¼, 7½, etc.), as is known in the art.

Figure 2:
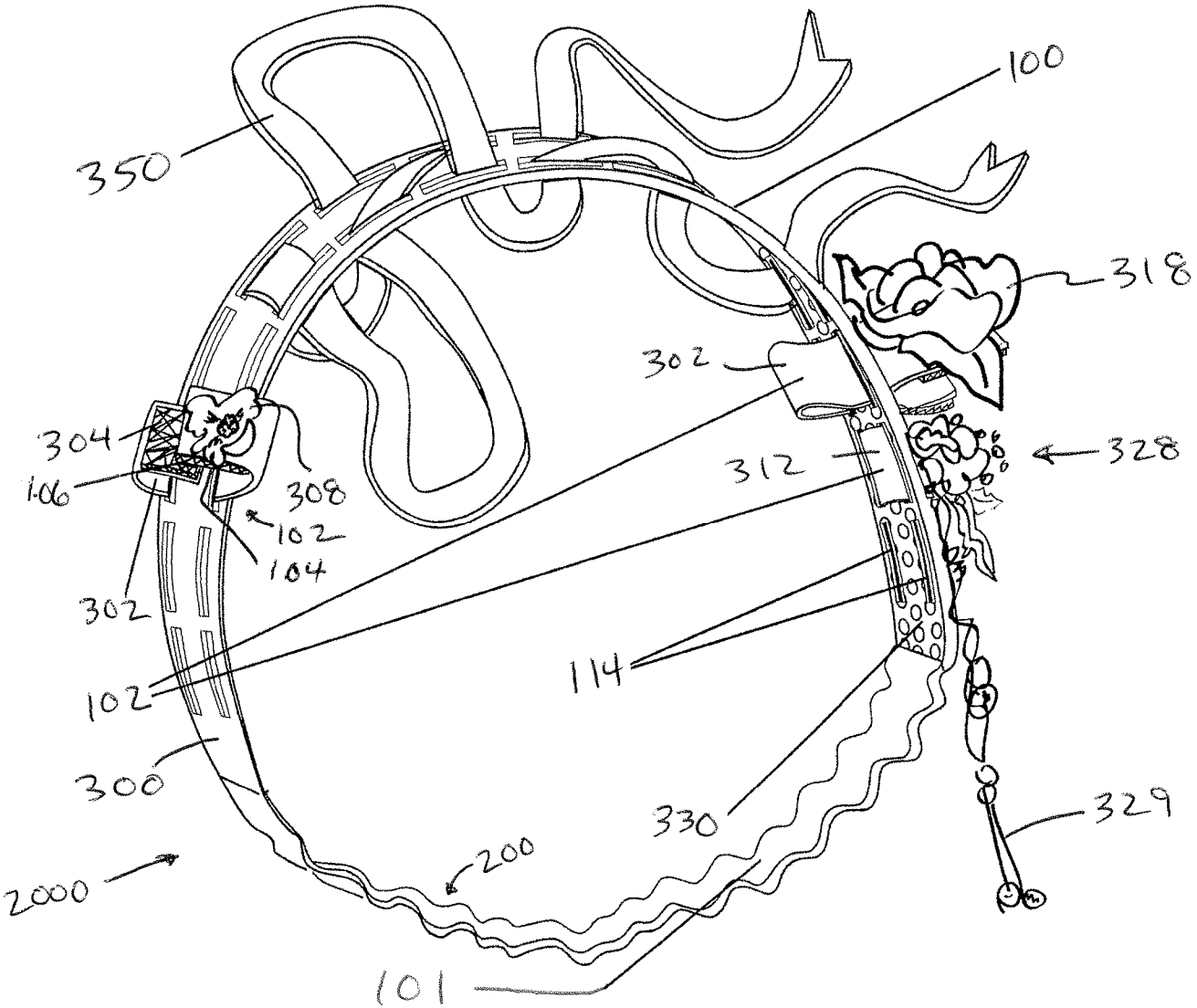
FIG. 2 depicts a perspective view of a fully assembled exemplary slotted headband system of FIGS. 1A-1D with exemplary adornments.

In a first embodiment, depicted in FIGS. 1A-2, the adornment support portion 101, 300 comprises two rows 115, 117 of symmetrical seamed slots 114 cut open, akin to buttonholes, preferably in symmetrical alignment, for receiving straps 102, 302, 312 on which adornments 108, 308, 318, 328 are secured. Slots 113 may also receive ribbons 350 or other decorative adornments not secured to such straps. The size of the slots 113 is generally at least slightly larger than the width of the adornment straps designed to fit within the slots, for ease of insertion of the straps. Nape elastic portion 200, which may comprise an elastic member 220 sandwiched between upper and lower soft fabric surface layers 222, connects to the adornment support section at first and second seams (e.g. seam edge 210 of nape elastic section 200 connects to seam edge 110 of the adornment support section 100, and seam edge 212 connects to seam edge 112), such that when so connected, the assembled headband 2000 forms a closed loop, as depicted in FIG. 2. To the extent that the adornment support comprises multiple layers of fabric, the slots 113 may penetrate the adornment support from a top layer to a bottom layer. In other embodiments (not shown), however, the slots may penetrate fewer than all of the layers, so that at least one unpenetrated layer is disposed adjacent to the wearer's head and the adornment straps, when secured to the adornment support, are disposed between the unpenetrated layer(s) and the penetrated layers between the slots in the penetrated layers.

Figure 3A:
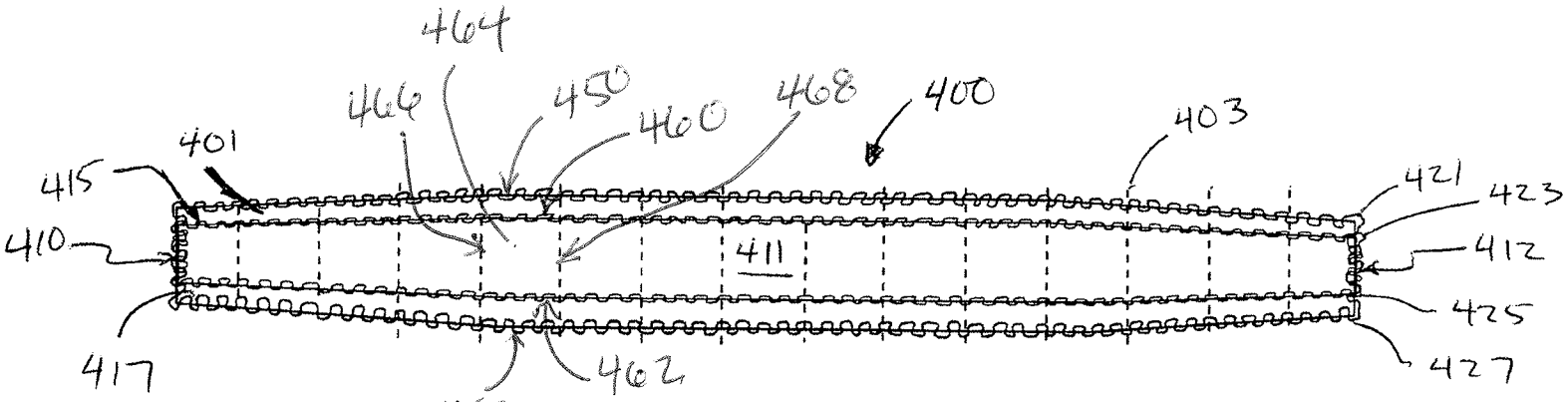
FIG. 3A depicts a plan view of one embodiment of an exemplary slotted loop adornment support portion.
Figure 3B:
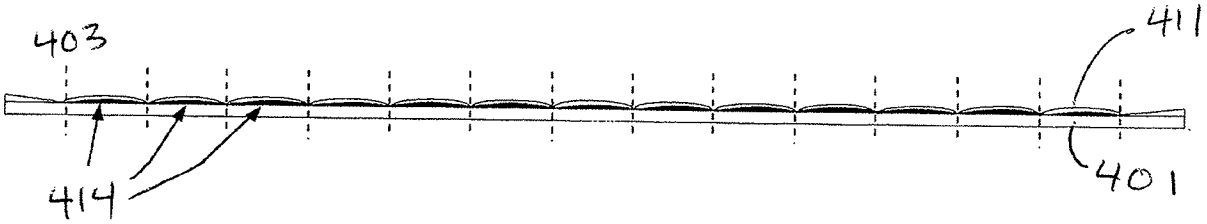
FIG. 3B depicts a side view of the exemplary slotted loop headband body of FIG. 3A.
Figure 4:
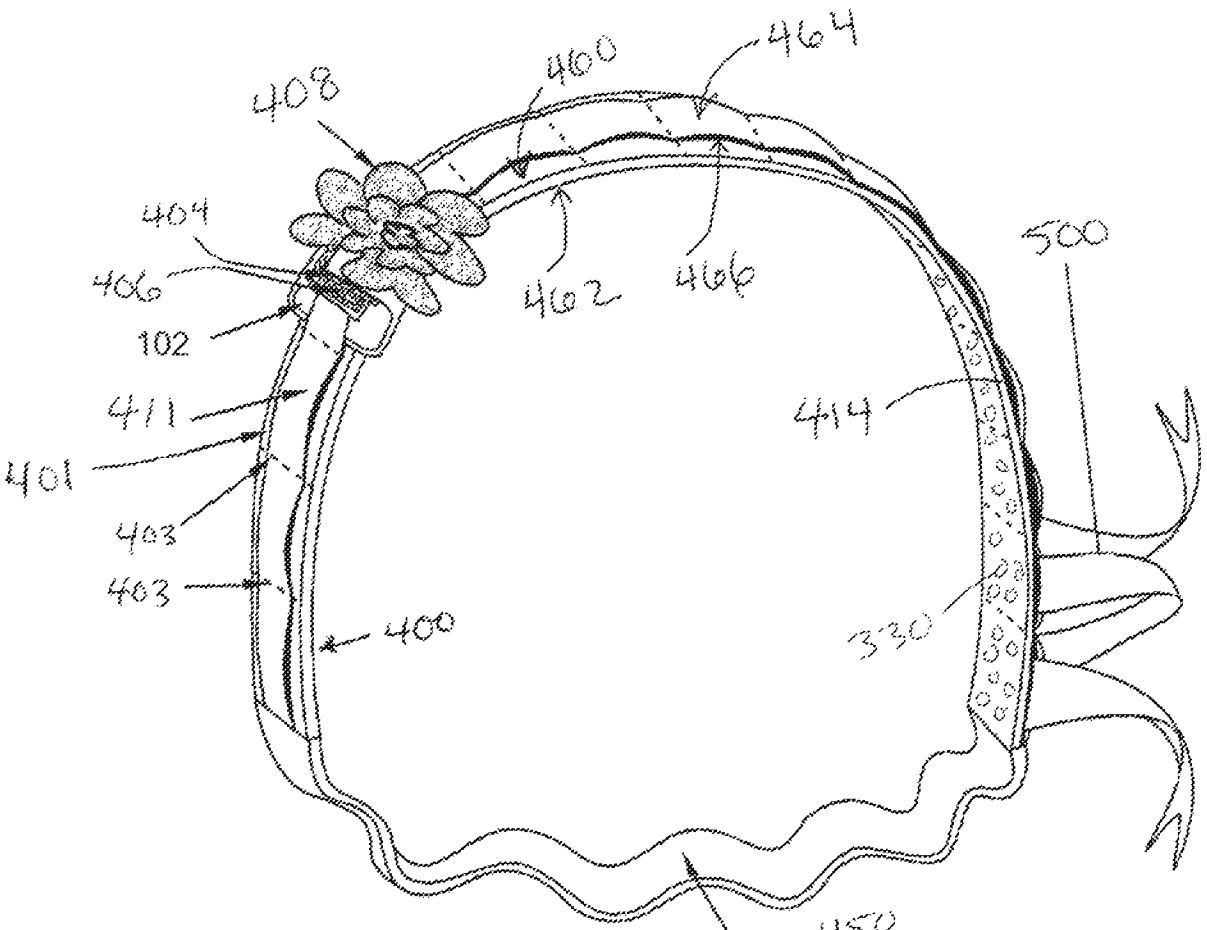
FIG. 4 depicts a perspective view of the fully assembled exemplary slotted loop headband system of FIGS. 3A and 3B, with exemplary adornments.

In a second embodiment, depicted in FIGS. 3A-4, the adornment support portion 400 comprises a plurality of slot pockets 414 formed by crosswise seams 403 connecting an upper, relatively narrower fabric outer layer 411 to a lower, relatively wider fabric bottom 401. Each fabric piece may have serger finished edges 421, 423, 425, 427 to limit fraying. The crosswise seams 403, which are preferably evenly spaced, create pockets 414 for receiving the adornment straps. The spacing of seams 403 is generally at least slightly larger than the width of the adornment straps designed to fit within the pockets defined by the seams, for ease of insertion of the straps. In some embodiments, the length of fabric outer layer 411 may also be slightly longer than fabric bottom 401 so that each pocket 414 has a slightly greater dimension bounded by the adjacent seams on the top (formed by layer 411) than on the bottom (formed by layer 401). Nape elastic portion 450 shown in FIG. 4, which may comprise elastic sandwiched between upper and lower soft fabric surface layers as illustrated with respect to nape elastic portion 200 in FIG. 1D, connects to the adornment support section at first and second seams (e.g. seam edge 210 of nape elastic section 200 connects to seam edge 410 of the adornment support section 400, and seam edge 212 connects to seam edge 412), such that when so connected, the headband forms a closed loop, as depicted in FIG. 4. As shown in FIG. 3A, the arrangement of narrower top portion 411 and wider bottom portion 401 defines portions 415 and 417 between the edge of the bottom portion and the edge of the top portion. It should be understood that in an alternate embodiment (not shown), the top and bottom may be of the same general length and width, and the top layer may have a cutout that conforms to at least the central portion of layer 411 depicted in FIG. 3A, such that rather than portions 415 and 417 as shown in FIG. 3A being part of bottom layer 401, the equivalent portions may comprise discrete fabric strip portions of the top layer that defines slots between adjacent seams 403 along the longitudinal edges of the adornment support section. Similarly, in yet another embodiment (not shown), portions 415 and 417 may be discrete strips of fabric attached to base 400 that create loops for holding adornment straps between seems 403.

Referring now to FIG. 4, bottom portion 401 can be characterized as having a first surface 460 and an opposite second surface 462, the second surface positioned for contact with a wearer's head or hair, and the first surface pointing away from the second surface (and facing away from a wearer's head or hair). Likewise, the too portion 411 can be characterized as having a first surface 464 and an opposite second surface 466, the top portion second surface 466 facing the bottom portion first surface 460 (and facing a wearer's head or hair), and the top portion second surface 464 facing away from the top portion first surface 466 (and facing away from a wearer's head or hair).

In some embodiments, as depicted in FIG. 2 but which may also be present in the embodiment illustrated in FIG. 4, the adornment support section may comprise a soft fabric outer layer (outer relative to the wearer's scalp or hair when worn) and an anti-slip fabric bottom 330 (in contact with the wearer's scalp or hair when worn), or both the outer and bottom layers may be soft fabric. Although use of an anti-allergenic, anti-slip fabric for the lower layer is may be particularly useful for patients with sensitive skin and little to no hair, such as chemotherapy patients, the design is not limited to any particular materials of construction. In particular, in some embodiments, such as those intended for users with normal hair, the anti-slip surface may be omitted to minimize cost. Although preferable to use an anti-slip layer of fabric, the anti-slip feature may be provided by a coating on the surface of the headband configured to contact the wearer's head (or hair).

In another embodiment, not shown, the adornment support may comprise a single hard shell structure, a hard shell with a soft and/or anti-slip fabric bottom, or a combination of hard and soft materials. The anti-slip layer, where present, may comprise a full bottom layer coextensive with the top layer, or one or more anti-slip fabric portions affixed to the top layer or affixed to a non-slip bottom layer. The headband may have one or more layers (not shown) intermediate to the top and bottom layers, such as but not limited to a fill. In some embodiments, particularly targeted to wearers with a normal head of hair, the adornment support may be held in the hair by any means known in the art (not shown) for securing an accessory in a wearer's hair, and may lack the nape portion as shown in some of the other embodiments.

In one embodiment, the adornment fastener strap 102 (also referred to herein as an "adornment strap" or simply a "strap" in shorthand, or as an "adornment fastener." genericallv) comprises a fabric strip with one component (e.g. the male, microhook portion) 104, 404 of a microhook/microloop fastener (e.g. Velcro@ brand) on a first (e.g. front) surface 102F at one end, and a mating component 106, 406 (e.g., the female, microloop portion) on the opposite (e.g. back) surface 102B at the opposite end. The strap is sized to permit the strap to be threaded through the slots or slot pockets in the support section, and then secured into a loop configuration with the male and female Velcro® fasteners mated together, as depicted in FIGS. 2 and 4. Thus, the strap has a width between its longitudinal edges that is at least slightly smaller than the width of the pocket into which it is configured to be disposed, for ease of insertion and removal. The design is not limited to any particular brand of microhook/microloop fastener, nor only to microhook/microloop fasteners, and therefore any type of fastener known in the art for securing one end of the loop to another may be provided, such as snaps, buttons, pins, magnets, and the like (not shown). Similarly, although adornment fastener 102 is shown as a rectangular strip of fabric, other materials and geometric configurations may be used for the adornment fasteners. The adornment 108 may be secured to strap 102 by any method known in the art, including but not limited to stitching, gluing, stapling, etc. In some embodiments, the strap may comprise a stiff finished fabric, a non-fabric (such as plastic) strip, and may have pre-defined creases A and B to permit them to be folded in predetermined places. Thus, in embodiments in which the adornment fastener strap comprises a relatively stiff material of construction, it also has a plurality of regions of relatively lesser stiffness at which the strap is sufficiently bendable to facilitate disposing the strap in the loop configuration. In particular, in embodiments in which the adornment fastener strap comprises plastic, the regions of relatively lesser stiffness may comprise crease lines.

Although shown in use with adornments, a headband having at least a portion of which as shown herein comprising symmetrical slots or slot pockets is also claimed. The headband has first and second longitudinal edges and a plurality of slots, the plurality of slots defining a plurality of openings aligned with and transversely spaced from the first and second longitudinal edges, each opening adjacent the first longitudinal edge having a symmetrically aligned counterpart opening adjacent and transversely spaced from the second longitudinal edge. Thus, for example, with reference to the embodiment depicted in FIG. 1C, slot 160 (defining a first opening) is transversely spaced from longitudinal edge 150, and slot 162 (defining a second opening that is a counterpart to and symmetrically-aligned with the first opening) is transversely spaced from longitudinal edges 152. With reference to FIG. 3A, slot 464 comprises a slot in the form of a slot pocket defined between relatively narrower fabric outer layer 411 and relatively wider fabric bottom between seams 466 and 468, with opening 460 adjacent and transversely spaced from longitudinal edge 450 and symmetrically-aligned counterpart opening 462 adjacent and transversely spaced from longitudinal edge 452. As shown, the headband portion has a first width W1 between its longitudinal edges at the center of the headband which tapers to a second thickness W2 closer to seams 110 and 112. Although this is a preferred configuration, the design is not limited to any particular geometry. Similarly, although elastic nape portion 200 shown in FIG. 1D is depicted in a configuration in which the width at the outer edges (adjacent the seams with the adornment support) is wider than in the center, the geometry of this portion is not limited to any particular geometry, either, and may, for example, have a constant width from end to end.

The adornments may comprise any aesthetic component desirable to a user, including but not limited to flowers 408, bejeweled sections (not shown), buttons (not shown), and dangling ornaments 329. One or more ribbons 350, 500 may instead or also be provided for fastening through the slots. The headband may be sold with adornments and/or adornments may be sold separately. The adornments may include seasonal or holiday themes (e.g. Christmas, Hanukkah, Easter, Valentine's Day, spring, fall, $4^{th}$ of July, etc.), may be color-coordinated, may have ethnic or cultural significance, or may have significance associated with a particular social, medical, or political cause, all without limitation. Although depicted with an exemplary number of slots, the number of slots may vary according to various designs and head sizes.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A headband comprising:

an adornment support portion having opposite adornment support portion longitudinal edges and an adornment support portion length defined by a first adornment support portion end and a second adornment support portion end opposite the first adornment support portion end, the adornment support portion comprising:

a fabric base portion having base portion opposite longitudinal edges, a first base portion surface and a second base portion surface opposite the first base portion surface, and a base portion length defined by a first base portion end that defines the first adornment support portion end and a second base portion end that defines the second adornment support portion end, the second base portion surface positioned to contact a wearer's head and the first base portion surface facing away from the second base portion surface, a fabric top portion having a first top portion surface and a second top portion surface opposite the first base portion surface, the second top portion surface facing the first base portion surface and the first top portion surface facing away from the second top portion surface, a first top portion end joined to the base portion in a first location with the first base portion surface in contact with the second top portion surface, and a second top portion end joined to the base portion in a second location with the first base portion surface in contact with the second top portion surface, the base portion and the top portion further connected to one another by a plurality of spaced crosswise seams distributed between the first location and the second location, each crosswise seam extending between the opposite adornment support portion longitudinal edges, the plurality of spaced crosswise seams defining a plurality of slot pockets bounded by the first base portion surface, the second top portion surface, and adjacent crosswise seams, each slot pocket having longitudinal openings adjacent and transversely spaced from the base portion opposite longitudinal edges;

at least one adornment fastener strap configured to be received in at least one of the adornment support portion slot pockets, the adornment fastener strap having fastener components disposed on opposite surfaces of opposite ends of the adornment fastener strap operable to secure the adornment fastener strap in a loop configuration; and an elastic nape section connected to the first adornment support portion end and the second adornment support portion end to dispose the headband in a closed loop configuration.

2. The headband of claim 1, wherein the elastic nape section is connected to the first adornment support portion end and the second adornment support portion end at connection seams.

3. The headband of claim 1, further comprising at least one ribbon adornment configured to be received in at least one of the adornment support portion slot pockets.

4. The headband of claim 1, wherein the fastener components comprise microloop/microhook fastener components.

5. The headband of claim 1, wherein the first-adornment fastener strap comprises fabric.

6. The headband of claim 1, wherein the adornment fastener strap comprises a relatively stiff material of construction and has a plurality of regions of relatively lesser stiffness at which the adornment fastener strap is sufficiently bendable to facilitate disposing the adornment fastener strap in the loop configuration.

7. The headband of claim 6, wherein the adornment fastener strap comprises plastic and the regions of relatively lesser stiffness comprise crease lines.

8. The headband of claim 1, wherein the fabric base portion comprises an anti-slip layer disposed on the second base portion surface.

9. The headband of claim 1, wherein the plurality of crosswise seams are evenly spaced.

10. The headband of claim 1, wherein the top portion is relatively narrower than the base portion and has top portion longitudinal edges transversely spaced from the base portion opposite longitudinal edges.

11. The headband of claim 10, wherein the plurality of crosswise seams are evenly spaced between the first location and the second location.

12. The headband of claim 1, wherein the first location is the first base portion end and the second location is the second base portion end.

13. The headband of claim 12, wherein the plurality of crosswise seams are evenly spaced between first location and the second location.

14. The headband of claim 13, wherein the top portion is relatively narrower than the base portion and has top portion longitudinal edges transversely spaced from the base portion opposite longitudinal edges.

15. The headband of claim 14, wherein the fabric base portion comprises an anti-slip layer disposed on the second base portion surface.

16. A method of adorning a user's head, the method comprising:

(a) disposing headband on the user's head, the headband comprising an adornment support portion having opposite adornment support portion longitudinal edges and an adornment support portion length defined by a first adornment support portion end and a second adornment support portion end opposite the first adornment support portion end, the adornment support portion comprising:

a fabric base portion having base portion opposite longitudinal edges, a first base portion surface and a second base portion surface opposite the first base portion surface, and a base portion length defined by a first base portion end that defines the first adornment support portion end and a second base portion end that defines the second adornment support portion end, the second base portion surface positioned to contact a wearer's head and the first base portion surface facing away from the second base portion surface, a fabric top portion having a first top portion surface and a second top portion surface opposite the first base portion surface, the second top portion surface facing the first base portion surface and the first top portion surface facing away from the second top portion surface, a first top portion end joined to the base portion in a first location with the first base portion surface in contact with the second top portion surface, and a second top portion end joined to the base portion in a second location with the first base portion surface in contact with the second top portion surface, the base portion and the top portion further connected to one another by a plurality of spaced crosswise seams distributed between the first location and the second location, each crosswise seam extending between the opposite adornment support portion longitudinal edges, the plurality of spaced crosswise seams defining a plurality of slot pockets bounded by the first base portion surface, the second top portion surface, and adjacent crosswise seams, each slot pocket having longitudinal openings adjacent and transversely spaced from the base portion opposite longitudinal edges; and an elastic nape section connected to the first adornment support portion end and the second adornment support portion end to dispose the headband in a closed loop configuration; and (b) securing at least one adornment fastener strap within at least one of the adornment support portion slot pockets, including at least one adornment fastener strap having fastener components disposed on opposite surfaces of opposite ends of the adornment fastener strap, including securing the adornment fastener strap in a loop configuration by attaching the opposite surfaces of the opposite ends to one another.

17. The headband of claim 1, wherein the at least one adornment fastener strap comprises at least one adornment attached to the adornment fastener strap.

18. The headband of claim 1, wherein the adornment is stitched, glued, or stapled to the adornment fastener strap.

* * * * *